US011773590B2

(12) United States Patent
Czyzewicz et al.

(10) Patent No.: US 11,773,590 B2
(45) Date of Patent: Oct. 3, 2023

(54) SYSTEM, METHOD AND APPARATUS FOR WALL SUPPORT OF CEILING SUSPENSION GRID

(71) Applicant: CERTAINTEED CEILINGS CORPORATION, Malvern, PA (US)

(72) Inventors: Robin C. Czyzewicz, Downingtown, PA (US); Bryan Neubeker, Bragg Creek (CA); Lorenzo Salazar, Westfield, IN (US); Thomas G. Murray, Collegeville, PA (US)

(73) Assignee: CERTAINTEED CEILINGS CORPORATION, Malvem, PA (US)

( * ) Notice: Subject to any disclaimer, the term of this patent is extended or adjusted under 35 U.S.C. 154(b) by 0 days.

(21) Appl. No.: 17/078,452

(22) Filed: Oct. 23, 2020

(65) Prior Publication Data

US 2021/0040742 A1 Feb. 11, 2021

Related U.S. Application Data

(63) Continuation of application No. 16/721,251, filed on Dec. 19, 2019, now Pat. No. 10,961,706, which is a (Continued)

(51) Int. Cl.
*E04B 9/12* (2006.01)
*E04B 9/06* (2006.01)
(Continued)

(52) U.S. Cl.
CPC ..... *E04B 9/12* (2013.01); *E04B 9/067* (2013.01); *E04B 9/127* (2013.01); *E04B 9/30* (2013.01); *E04B 9/241* (2013.01)

(58) Field of Classification Search
CPC . E04B 9/127; E04B 9/30; E04B 9/067; E04B 9/16; E04B 9/34; E04B 9/12
See application file for complete search history.

(56) References Cited

U.S. PATENT DOCUMENTS 2,667,667 A 2/1954 Jacobson
2,710,679 A 6/1955 Bibb et al.
(Continued)

FOREIGN PATENT DOCUMENTS

WO 2017210071 A1 12/2017

OTHER PUBLICATIONS

International Search Report and Written Opinion for PCT/US2017/034398, dated Aug. 8, 2017, 13 pages.
(Continued)

*Primary Examiner* — Gisele D Ford
(74) *Attorney, Agent, or Firm* — Abel Schillinger, LLP; Thomas H. Osborn

(57) ABSTRACT

A ceiling suspension system is disclosed and includes a plurality of grid members configured to form a grid for the ceiling suspension system, each grid member comprising a bulb, a web and a flange. The system also includes a plurality of wall support brackets configured to mount the grid to walls in a structure. Each wall support bracket comprises a vertical back, a lower flange at a lower end of the vertical back, and an upper flange at an upper end of the vertical back. Further, the upper flange is generally V-shaped when viewed longitudinally and each wall support bracket only one tab in the lower flange for each grid member. Moreover, the only one tab is configured to engage and retain the flange of a respective grid member, such that the respective grid member rests on the lower flange.

10 Claims, 10 Drawing Sheets

Related U.S. Application Data continuation of application No. 16/183,907, filed on Nov. 8, 2018, now Pat. No. 10,550,571, which is a continuation of application No. 15/604,947, filed on May 25, 2017, now Pat. No. 10,151,110.

(60) Provisional application No. 62/344,020, filed on Jun. 1, 2016.

(51) Int. Cl.
*E04B 9/30* (2006.01)
*E04B 9/24* (2006.01)

(56) References Cited

U.S. PATENT DOCUMENTS

| | | | |
|---|---|---|---|
| 2,946,414 | A | 7/1960 | Gordon et al. |
| 2,990,921 | A | 7/1961 | Wilde |
| 3,283,467 | A | 11/1966 | Znamirowski |
| 3,798,865 | A | 3/1974 | Curtis |
| 3,898,782 | A | 8/1975 | Donato |
| 3,999,875 | A | 12/1976 | Simon |
| 4,586,841 | A | 5/1986 | Hunter |
| 4,610,562 | A | 9/1986 | Dunn |
| 4,630,423 | A | 12/1986 | Lind |
| 5,046,294 | A | 9/1991 | Platt |
| 5,177,929 | A | 1/1993 | Reynolds |
| 5,195,289 | A | 3/1993 | Lalonde et al. |
| 5,263,295 | A | 11/1993 | Laird et al. |
| 5,396,748 | A | 3/1995 | Rogers |
| 5,937,605 | A | 8/1999 | Wendt |
| 6,374,558 | B1 | 4/2002 | Surowiecki |
| 6,516,581 | B2 | 2/2003 | Paul et al. |
| 6,516,582 | B2 | 2/2003 | Paul et al. |
| 6,523,313 | B2 | 2/2003 | Lin et al. |
| 6,763,641 | B1 | 7/2004 | Ahren et al. |
| 7,143,562 | B2 | 12/2006 | Krantz-Lilienthal et al. |
| 7,240,460 | B2 | 7/2007 | Platt |
| 7,278,243 | B2 | 10/2007 | Jones et al. |
| 7,578,107 | B2 | 8/2009 | Platt |
| 7,690,168 | B2 | 4/2010 | Lalonde |
| 7,779,593 | B2 | 8/2010 | Jahn et al. |
| 7,788,875 | B2 | 9/2010 | Wendt |
| 7,832,171 | B2 | 11/2010 | Erickson et al. |
| 7,975,448 | B2 | 7/2011 | Jahn et al. |
| 8,578,673 | B2 | 11/2013 | Kelly et al. |
| 8,590,275 | B2 | 11/2013 | Platt |
| 9,127,456 | B2 | 9/2015 | Dollerup et al. |
| 9,255,403 | B1 | 2/2016 | Lehane et al. |
| 9,909,312 | B2 | 3/2018 | Lehane et al. |
| 10,151,110 | B2 | 12/2018 | Czyzewicz et al. |
| 10,550,571 | B2 | 2/2020 | Czyzewicz et al. |
| 2004/0194417 | A1 | 10/2004 | Paul |
| 2006/0010811 | A1 | 1/2006 | Platt |
| 2006/0010812 | A1* | 1/2006 | Jones ..... E04B 9/068 52/506.07 |
| 2006/0016139 | A1 | 1/2006 | Beck et al. |
| 2007/0056245 | A1 | 3/2007 | Edmondson |
| 2007/0130869 | A1 | 6/2007 | Platt |
| 2008/0229680 | A1 | 9/2008 | Jahn et al. |
| 2008/0236068 | A1 | 10/2008 | Jahn et al. |
| 2011/0146194 | A1 | 6/2011 | Tedesco et al. |
| 2012/0137614 | A1 | 6/2012 | Wendt |
| 2016/0153189 | A1 | 6/2016 | Wright |
| 2017/0226736 | A1 | 8/2017 | Lehane et al. |
| 2017/0350120 | A1 | 12/2017 | Czyzewicz et al. |
| 2017/0362828 | A1 | 12/2017 | Czyzewicz et al. |
| 2020/0123770 | A1 | 4/2020 | Czyzewicz et al. |

OTHER PUBLICATIONS

ShortSpan™ Drywall Framing System, 2011, 2 pages, Armstrong®, US.

Suspension Systems, Chicago Metallic SpanFast™ Drywall Grid System, 2015, 3 pages, Rockfon North America, US.

USG™ Drywall Suspension System—Wall-to-Wall, 2010, pp. 100-101, USG Interiors, Inc., US.

* cited by examiner

SYSTEM, METHOD AND APPARATUS FOR WALL SUPPORT OF CEILING SUSPENSION GRID

CROSS-REFERENCE TO RELATED APPLICATION

This application is a continuation of and claims priority under 35 U.S.C. § 120 to U.S. patent application Ser. No. 16/721,251, entitled "SYSTEM, METHOD AND APPARATUS FOR WALL SUPPORT OF CEILING SUSPENSION GRID," naming Robin C. CZYZEWICZ et al. as inventors, filed Dec. 19, 2019, which is a continuation of and claims priority to U.S. patent application Ser. No. 16/183,907, entitled "SYSTEM, METHOD AND APPARATUS FOR WALL SUPPORT OF CEILING SUSPENSION GRID," naming Robin C. CZYZEWICZ et al. as inventors, filed Nov. 8, 2018, now U.S. Pat. No. 10,550,571, which is a continuation of and claims priority to U.S. patent application Ser. No. 15/604,947, entitled "SYSTEM, METHOD AND APPARATUS FOR WALL SUPPORT OF CEILING SUSPENSION GRID," naming Robin C. CZYZEWICZ et al. as inventors, filed May 25, 2017, now U.S. Pat. No. 10,151,110, which claims priority under 35 U.S.C. § 119(e) to U.S. Provisional Application No. 62/344,020, entitled "SYSTEM, METHOD AND APPARATUS FOR WALL SUPPORT OF CEILING SUSPENSION GRID," naming Robin C. CZYZEWICZ et al. as inventors, filed Jun. 1, 2016, all which are assigned to the current assignee hereof and are incorporated herein by reference in their entireties.

BACKGROUND OF THE INVENTION

Field of the Disclosure

The present invention relates in general to ceilings and, in particular, to a system, method and apparatus for wall support of a ceiling suspension grid.

Description of the Prior Art

As shown in FIG. 1, conventional ceiling systems 21 may include a plurality of support members. The support members may be configured in many forms, such as main beams or runners 23 and cross tees 25 that rest on top of and are fastened to wall angle 26. A typical support member or grid member includes a top with a bulb 31, a web 33 extending downward from the bulb 31, and a bottom with a flange 35 extending from the web 33 opposite the bulb 31. The support members may be suitably roll-formed steel or aluminum, extruded aluminum, plastic, or fiber-reinforced plastic (FRP), depending on the application.

The metal raw materials (e.g., steel, aluminum, etc.) used in the roll-forming process arrives at the plant in coils. This material is about several inches wide, and about 0.012 to 0.020 inches thick, depending on the load rating desired for the finished grid product. For some applications, the steel is about 0.015 inches thick. The coils are unwound into a roll forming machine, which comprises a series of roll sets that progressively bend or fold the metal into the final shape desired. Each roll set represents a "step" in the process of roll-forming. Depending on the complexity of the final shape, the number of roll sets can be as few as two or three (such as for forming a rain gutter), to as many as needed. For ceiling suspension T-bar type grids, the number of roll sets is generally about 16. A capping material, which also arrives at the plant in coils that are typically about 1 1/16 inches in width for a 15/16 inch-wide support members, is introduced at one of the later roll sets. This material can be steel or aluminum and is generally white, but could be any color. This material is crimped tightly onto the T-bar shape, which is formed continuously. A shear cuts the finished shape into pieces of the length desired. In the case of main runners, this is about 12 feet. Cross tees are commonly four feet and two feet in length, but can be custom made to any length. The slots, holes, and end joinery are added later in the process in a press.

The support members for the ceiling system interconnect to form a ceiling suspension. The ceiling suspension may be suspended with wires or hangers 27 from a roof or floor support structure (not shown) in a building. The main runners 23, cross tees 25 and wall angle 26 may be substantially perpendicular, such that the ceiling suspension forms an orthogonal grid for supporting drywall panels (e.g., gypsum panels; not shown) below flanges 35 or ceiling tiles 29 above flanges 35, as is known by those of ordinary skill in the art. The panels or tiles are supported by the ceiling suspension to form a more aesthetically appealing ceiling beneath the usually less appealing exposed structure of a building. Although such conventional designs are feasible, improvements in ceiling support systems continue to be of interest.

SUMMARY

Embodiments of a system, method and apparatus for a wall support for a ceiling support grid with grid members are disclosed. Each grid member can have a top with a bulb, a web extending downward from the bulb, and a bottom with a flange extending from the web opposite the bulb. Examples of the wall support may include a bracket having a C-shaped channel with a back, a lower flange at a lower end of the back, and an upper flange at an upper end of the back. In addition, the bracket may include only one tab in the lower flange for each grid member. The only one tab may be configured to engage and retain the flange of a respective grid member. The grid member may rest on the lower flange. The lower flange may have no other features for positive engagement with and retention of the flange of the respective grid member.

Another embodiment of a wall support for a ceiling support grid may include an upper flange that is generally V-shaped. Yet another embodiment of a wall support may include only one hole in an upper flange for each grid member. The bulb of each grid member may be configured to be located adjacent a respective only one hole in the upper flange. Still another embodiment of a wall support can include the bulbs of grid members being configured to seat and be retained in respective holes in the upper flange. In another embodiment, each hole in the upper flange may be configured to receive a bulb of a respective grid member.

In other embodiments, a ceiling suspension system may be provided. The ceiling suspension system can include a plurality of grid members configured to form a grid for the ceiling suspension system. Each grid member may include a bulb, a web and a flange. The ceiling suspension system can further include a plurality of wall support brackets. The brackets may be configured to mount the grid to walls in a structure. In addition, each bracket may include at least one of the following: (1) only one tab in the lower flange for each grid member, wherein the only one tab is configured to engage and retain the flange of a respective grid member, such that the respective grid member rests on the lower flange, and the lower flange has no other features for positive engagement with and retention of the flange of the respective grid member; (2) the upper flange is generally V-shaped when viewed longitudinally; (3) only one hole is formed in the upper flange for each grid member, such that the bulb of each grid member is configured to be located adjacent a respective only one hole in the upper flange; and (4) the bulbs of the grid members are configured to seat in holes in the upper flange.

In still another embodiment, a method of installing a ceiling suspension system is disclosed. For example, the method may include providing a C-channel having an upper flange and a lower flange, and a grid member having a bulb, a web and a flange. The method also may include inserting the grid member into the C-channel between the upper and lower flanges. In an example, the method further comprise initially orienting the grid member at an angle relative to the C-channel, as shown, such that the grid member is not vertically upright. In addition, the method may include rotating the grid member until the bulb engages a hole in the upper flange. Finally, the method may include further rotating the grid member until the flange is captured by a tab in the lower flange.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1:
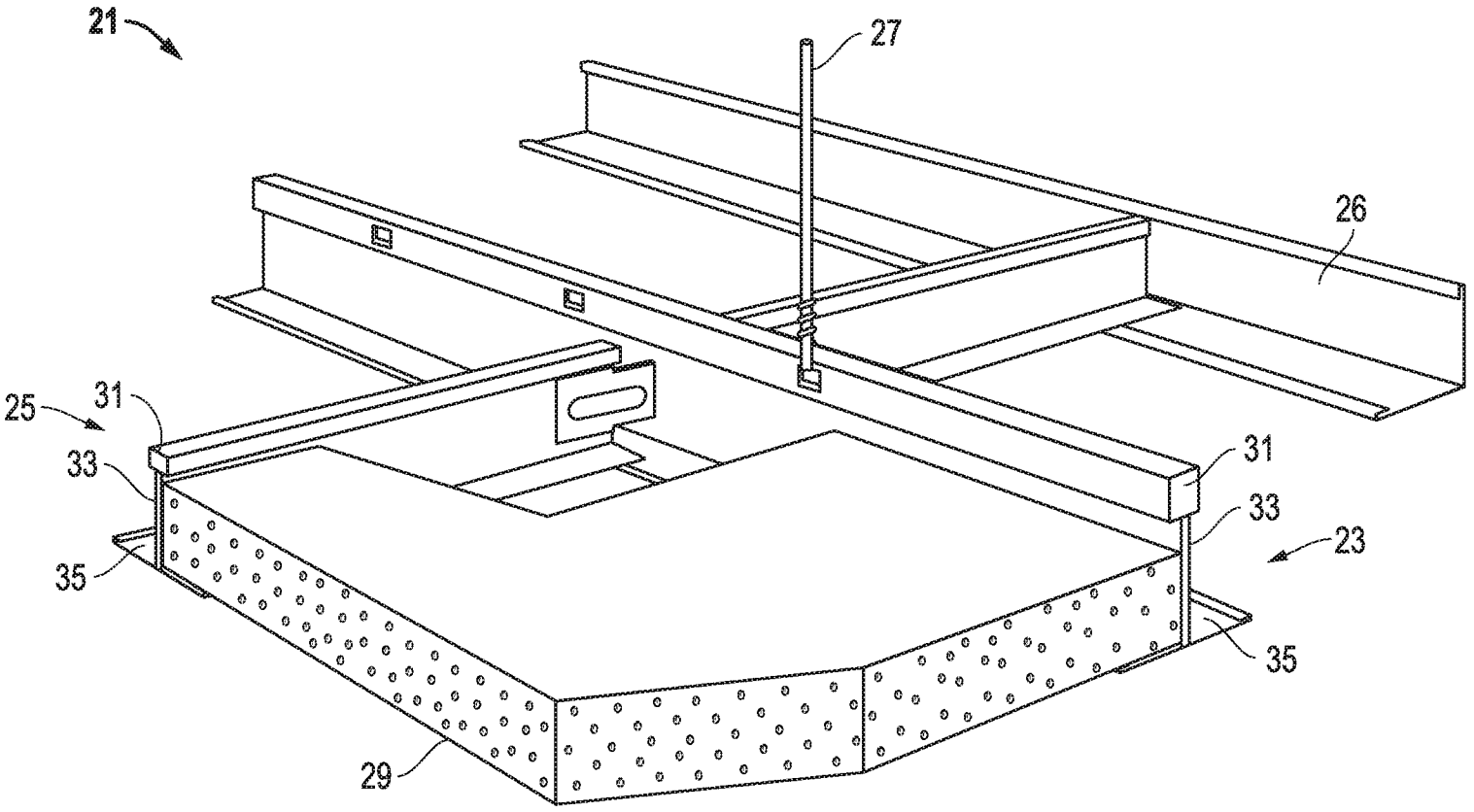
FIG. 1 (Prior Art)
FIG. 1 is a schematic drawing of a conventional ceiling suspension system.
Figure 2:
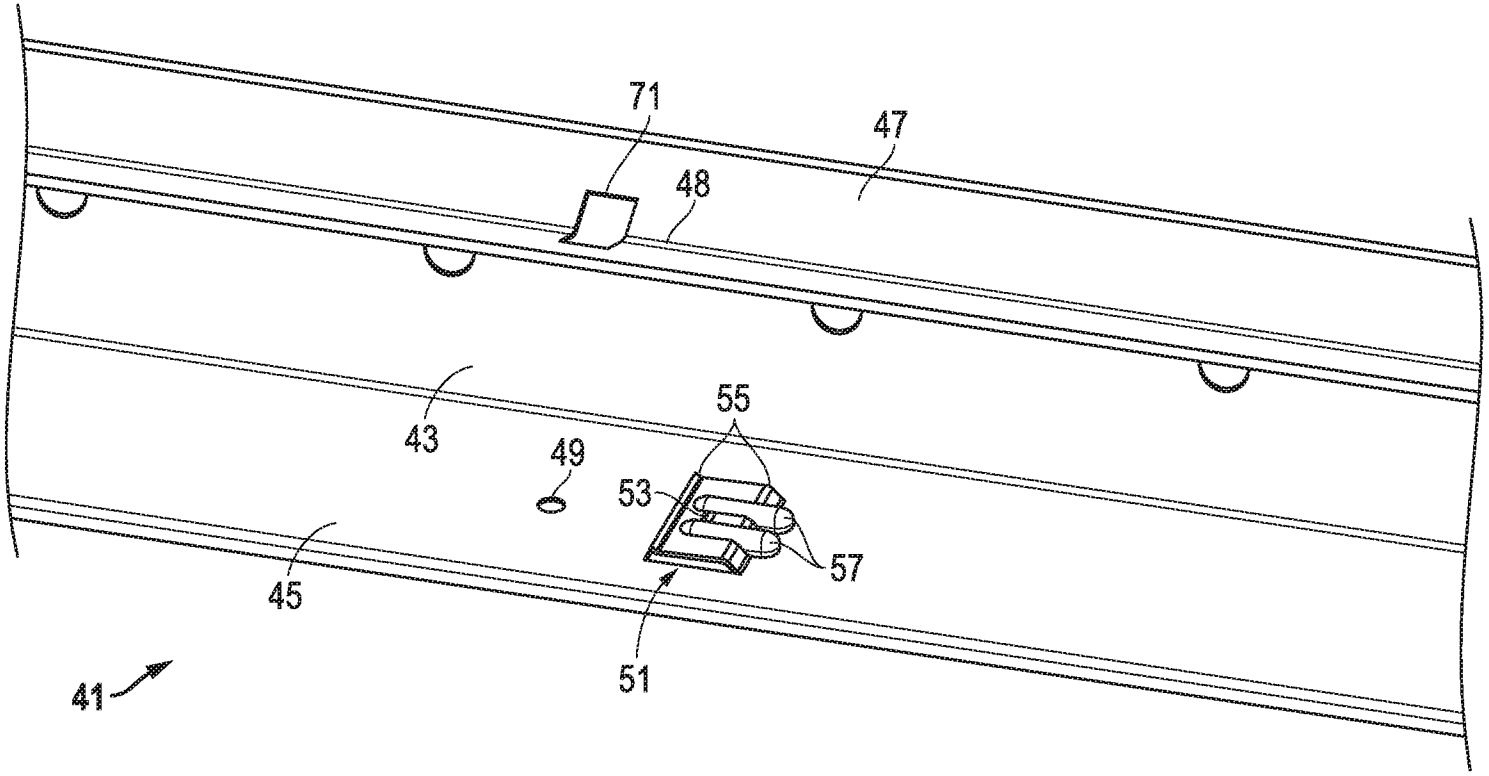
FIG. 2 is a top, front isometric view of an embodiment of a wall bracket.
Figure 3:
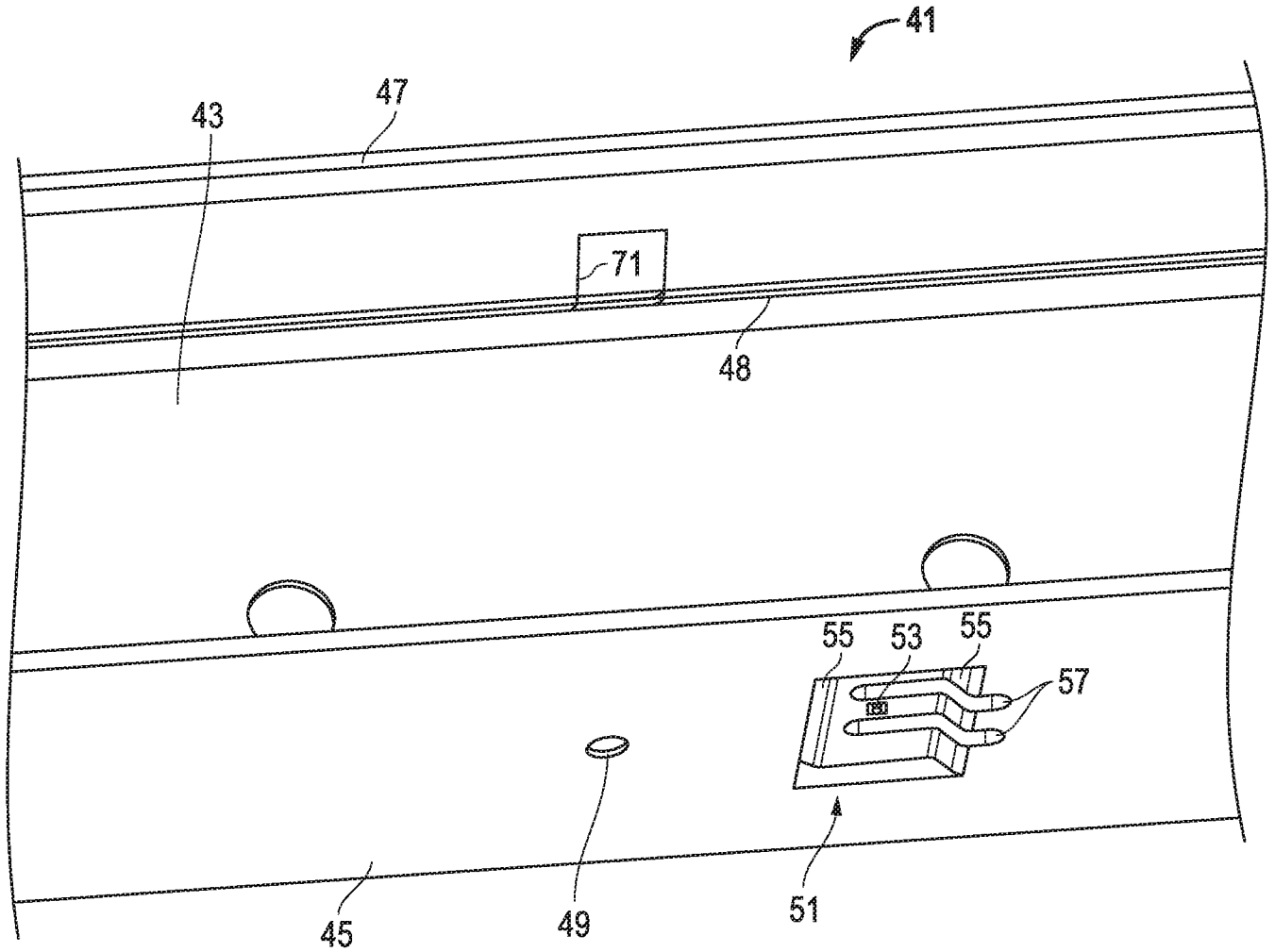
FIG. 3 is a bottom, front isometric view of the wall bracket of FIG. 2.

Embodiments of a system, method and apparatus for wall support of a ceiling suspension system are disclosed. For example, FIGS. 2-7 depict an embodiment of a wall support or bracket 41. Bracket 41 is suitable for supporting a ceiling support structure or grid, such as the one shown in FIG. 1. The structure or grid may include crossing support members, such as the main beam runners 23 and cross tees 25 in FIG. 1, the parallel grid members 60 in FIG. 7, or still other configurations.

Versions of the bracket 41 may comprise a channel that, when viewed longitudinally (FIG. 4), is generally C-shaped. The bracket 41 may include a vertical back 43, a lower flange 45 at a lower end of the vertical back 43, and an upper flange 47 at an upper end of the vertical back 43. The upper flange 47 may be V-shaped. In an example, the vertical back 43 and the lower flange 45 can be substantially perpendicular to each other.

Figure 7:
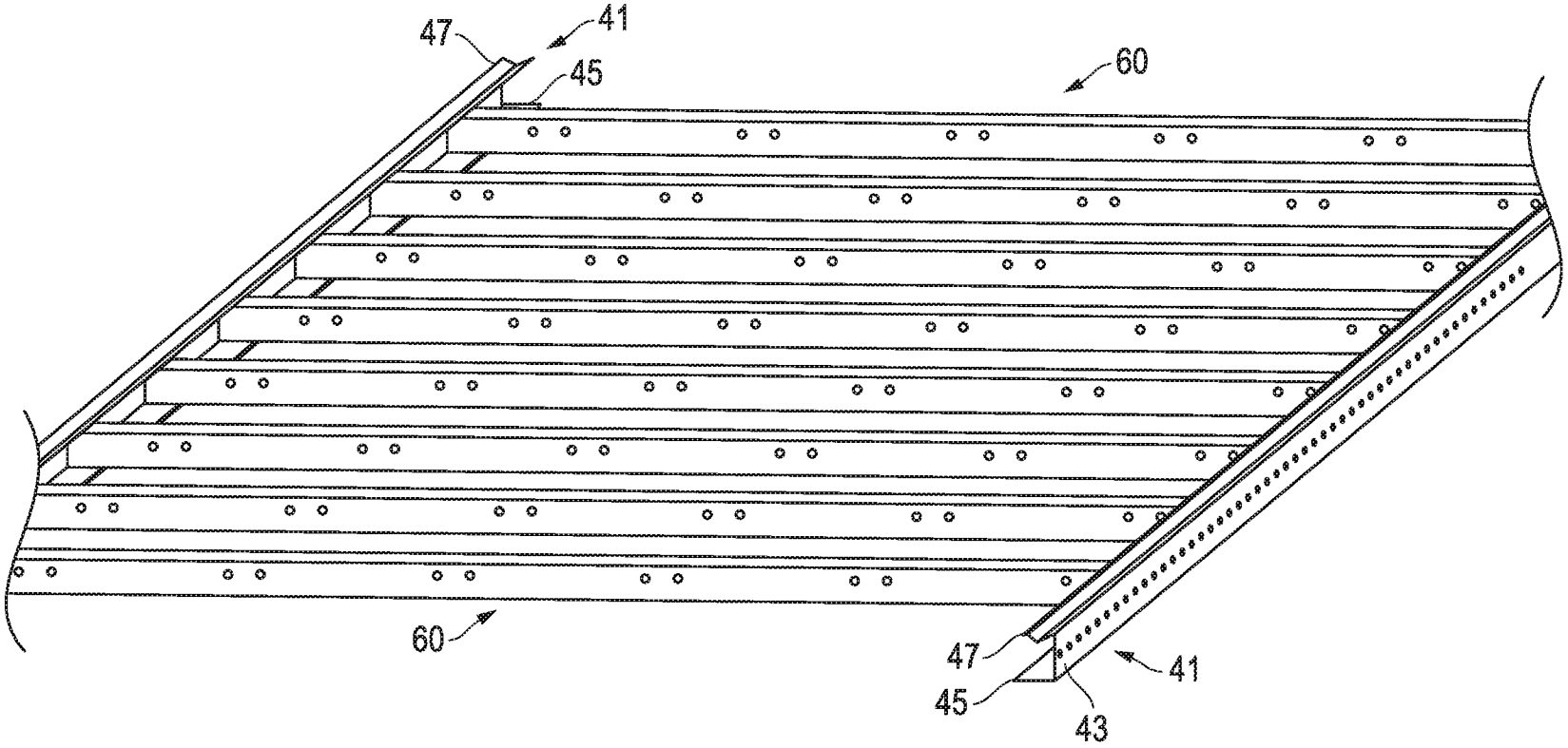
FIG. 7 is a top, front isometric view of an embodiment of the wall bracket of FIG. 2 in an assembly with ceiling support members.

In some embodiments, the bracket 41 may include only one tab 51 in the lower flange 45 for each grid member 60. See, e.g., FIG. 6C, where grid member 60 includes bulb 61, web 63 flange 65, and return fold 66. Examples of the only one tab 51 may be configured to engage and retain the flange 65 of a respective grid member 60. The respective grid member 60 may rest on the lower flange 45 (FIG. 7). Embodiments of the lower flange 45 may include no other features for positive engagement with and retention of the flange 65 of the respective grid member 60. A version of the only one tab 51 may be inclined downward toward the lower flange 45, such that the only one tab 51 is not parallel to the lower flange. Another version of the only one tab 51 may be substantially parallel to the lower flange 45.

An example of the lower flange 45 may further include a pilot hole 49. For example, the pilot hole 49 may be located adjacent the only one tab 51. The pilot hole 49 may be configured to receive a fastener (not shown) to engage and secure the flange 65 of the grid member 60.

Embodiments of the bracket 41 may provide the only one tab 51 with a locking feature 53. The locking feature 53 may be configured to engage and retain the flange of the respective grid member 60 in the only one tab 51. In an example, the locking feature 53 may comprise a finger that depends downward from and extends in a substantially opposite direction as the only one tab 51.

Some versions of the only one tab 51 may include diagonally-oriented end portions 55. In addition, the only one tab 51 may comprise at least one reinforcement rib 57 (e.g., two shown) for stiffness. An example of the reinforcement ribs 57 may have a rib height RH (FIG. 4) that is greater than a height TH of the only one tab 51. Versions of the reinforcement ribs 57 may be substantially parallel, and substantially cylindrical. The reinforcement ribs 57 can extend from the only one tab 51, in an opposite direction of the only one tab 51, to the lower flange 45.

Figure 4:
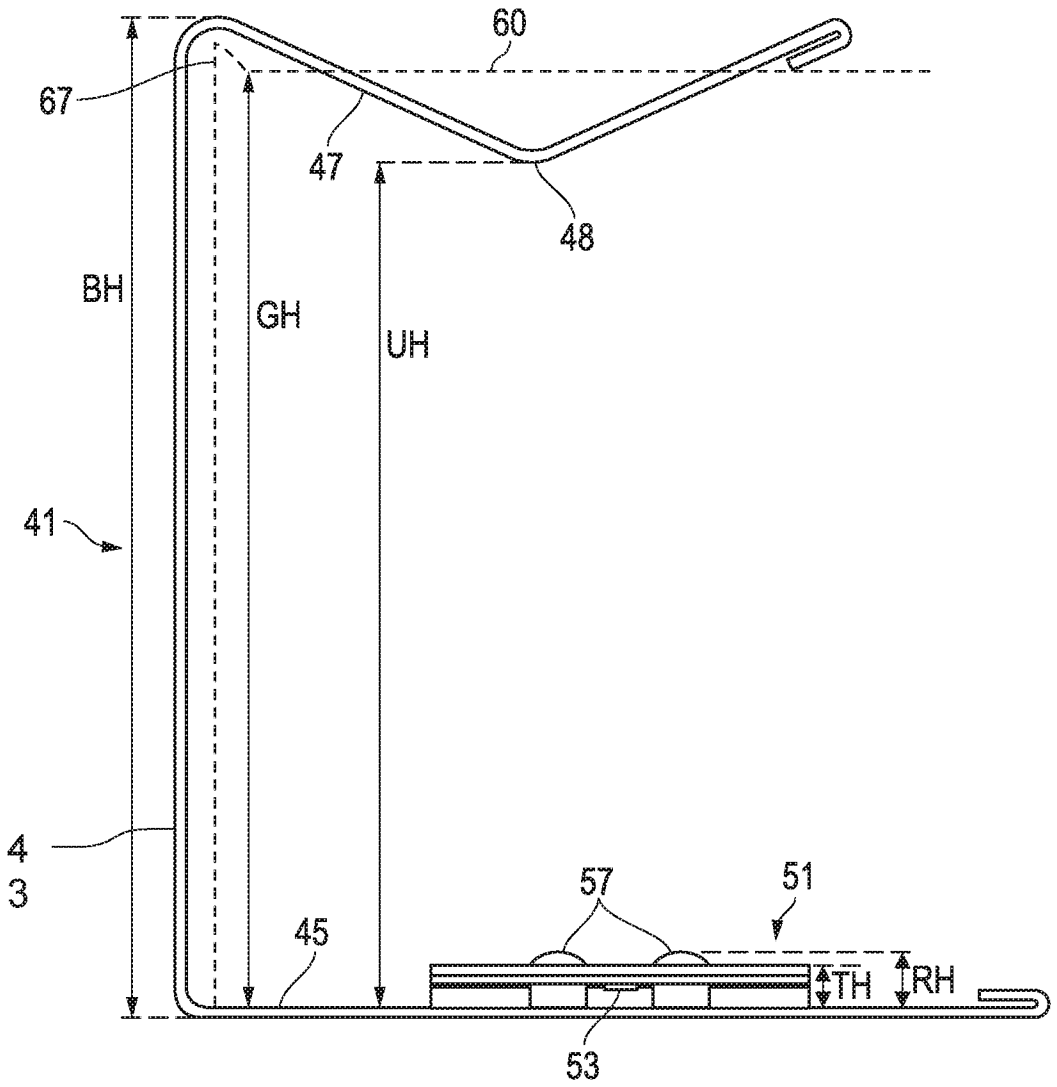
FIG. 4 is an end view of the wall bracket of FIG. 2.
Figure 5:
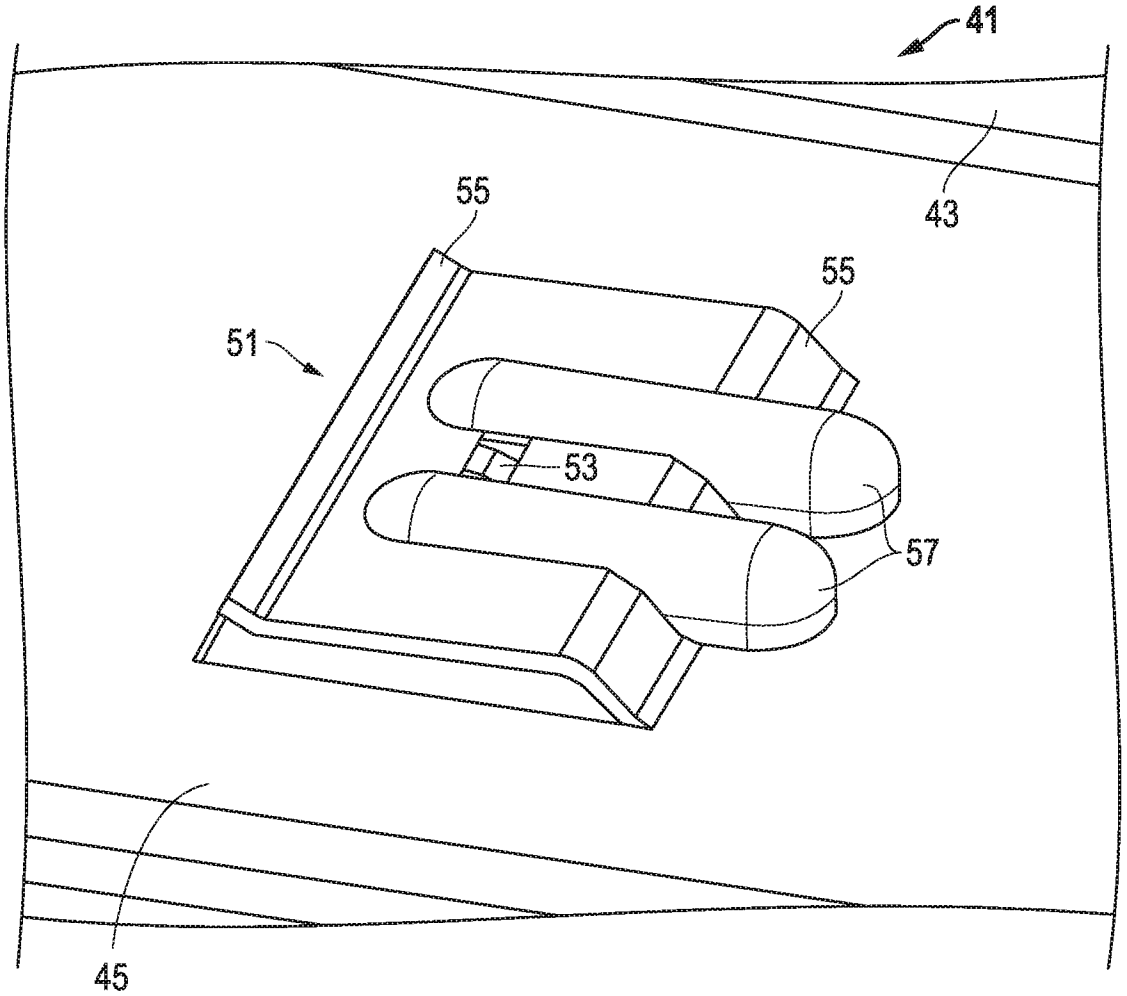
FIG. 5 is an enlarged, top, front isometric view of a portion of a lower flange of the wall bracket of FIG. 2.
Figure 6A:
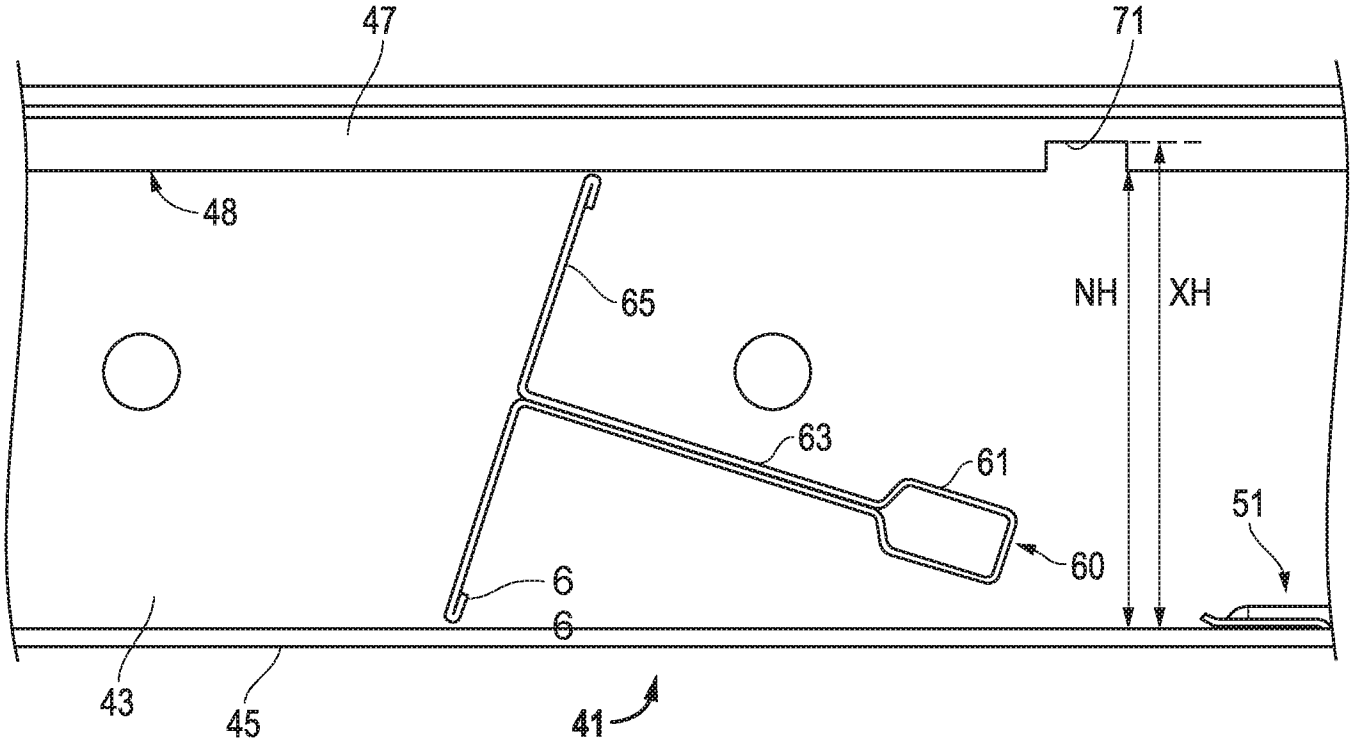
FIGS. 6A-6C are sequential front images of a support member being installed in the wall bracket of FIG. 2.
Figure 6B:
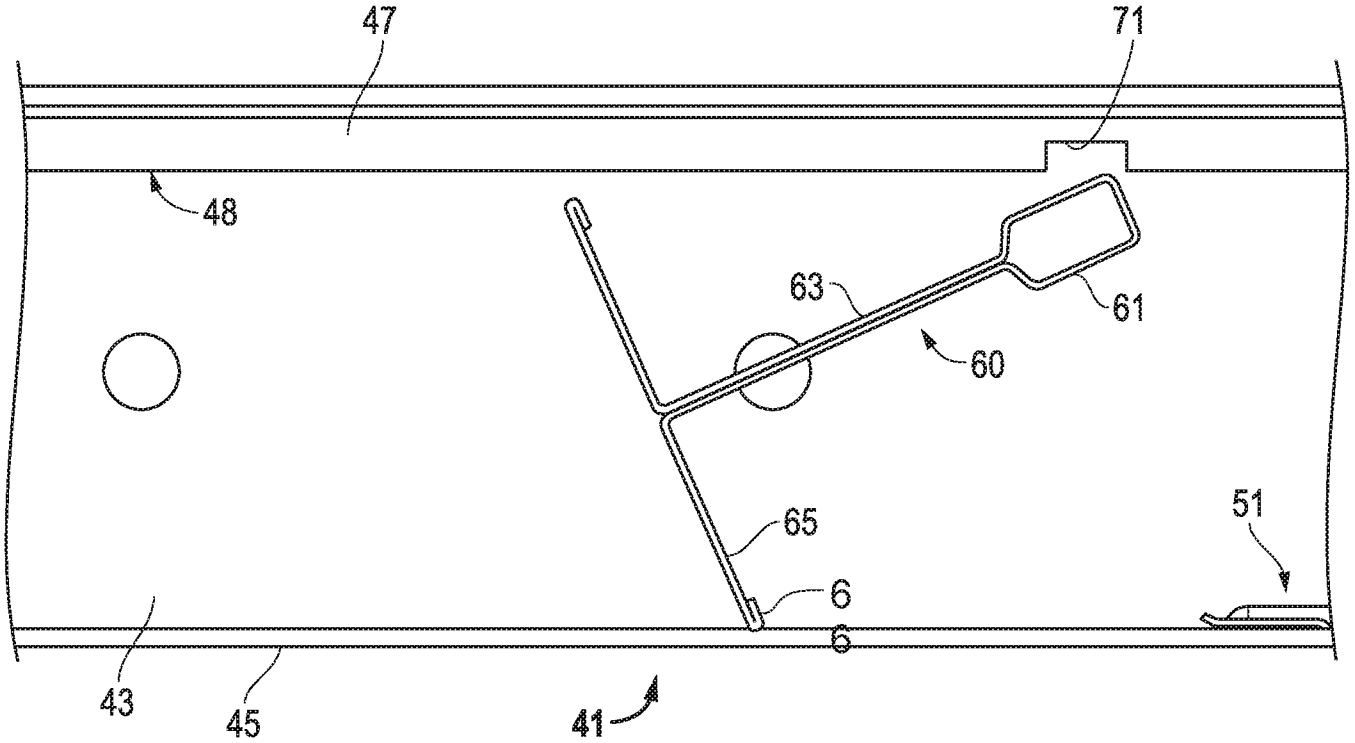
Figure 6C:
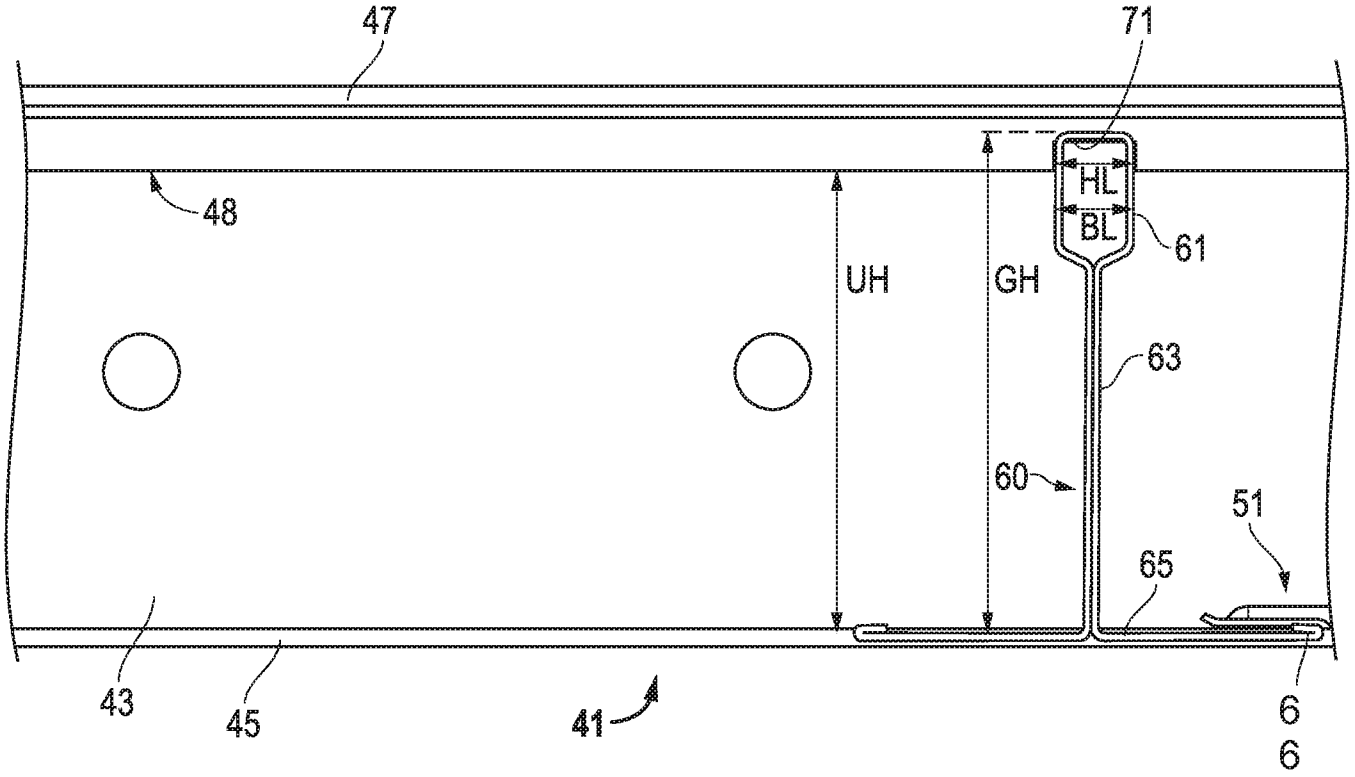

Embodiments of the bracket 41 may provide the upper flange 47 with a unique geometry. For example, the upper flange 47 can be generally V-shaped when viewed longitudinally (FIG. 4). Versions of the upper flange 47 may include a height UH of an apex 48 of the upper flange 43 above the lower flange 45. The height UH can be less than a height GH (FIG. 6C) of the grid members 60. Examples of the vertical back 43 may include a height BH can be greater than the height GH of the grid members 60. The height BH can provide clearance for manufacturing vestiges 67 at the end of grid member 60. In some examples, the apex 48 of the upper flange 47 may be radiused or at least partially flat. The V-shaped portions of upper flange 47 may be canted at various angles, such as in a range of about 20 degrees to about 30 degrees.

In other examples, the bracket 41 may be provided with only one hole 71 in the upper flange 47 for each grid member 60. Versions of holes 71 may comprise slots, such as rectangular slots. Embodiments of the bracket 41 having only one hole 71 may be configured such that the bulb 61 of each grid member 60 is located adjacent thereto in the upper flange 47. Versions of the bracket 41 having only one hole 71 may be provided with a longitudinal length HL (FIG. 6C) that is greater than the length BL of the bulb 61. Examples of the bracket 41 having only one hole 71 can be non-flat, such as the V-shape of the illustrated upper flange 47.

Embodiments of the only one hole 71 may be configured to engage and prevent rotation and torsion of a respective one of the grid members 60, in cooperation with the only one tab 51. An example of the only one hole 71 may be provided a minimum height NH (FIG. 6A) above the lower flange 45, and a maximum height XH above the lower flange 45. Both the minimum and maximum heights NH, XH can be less than the height GH (FIG. 6C) of the grid members 60. In this example, the upper flange 47 must flex or deflect upward so that the bracket 41 can receive the grid member 60. Thus, embodiments of the bracket 41 may be configured such that the bulbs 61 of the grid members 60 (FIG. 7) seat in and are retained in respective holes 71 in the upper flange 47.

In other embodiments, a ceiling suspension system may be provided. The ceiling suspension system can include a plurality of grid members 60 configured to form a grid for the ceiling suspension system. Each grid member 60 may include a bulb 61, a web 63 and a flange 65. The ceiling suspension system can further include a plurality of wall support brackets 41. The brackets 41 may be configured to mount the grid to walls in a structure. In addition, each bracket 41 may include at least one of the following: (1) only one tab 51 in the lower flange 45 for each grid member 60, wherein the only one tab 51 is configured to engage and retain the flange 65 of a respective grid member 60, such that the respective grid member 60 rests on the lower flange 45, and the lower flange 45 has no other features for positive engagement with and retention of the flange 65 of the respective grid member 60; (2) the upper flange 47 is generally V-shaped when viewed longitudinally; (3) only one hole 71 is formed in the upper flange 47 for each grid member 60, such that the bulb 61 of each grid member 60 is configured to be located adjacent a respective only one hole 71 in the upper flange 47; and (4) the bulbs 61 of the grid members 60 are configured to seat in holes in the upper flange.

In still another embodiment, a method of installing a ceiling suspension system is disclosed. For example, the method may include providing a C-channel (e.g., bracket 41) having an upper flange 47 and a lower flange 45, and a grid member 60 having a bulb 61, a web 63, a flange 65, and a return fold 66. The method also may include inserting the grid member 60 (FIG. 6A) into the C-channel 41 between the upper and lower flanges 47, 45. In an example, the method further comprise initially orienting the grid member 60 at an angle relative to the C-channel 41, as shown, such that the grid member 60 is not vertically upright. In addition, the method may include rotating the grid member 60 until the bulb 61 engages a hole 71 (FIG. 6B) in the upper flange 47. Finally, the method may include further rotating the grid member 60 until the return fold 66 of the flange 65 is captured by a tab 51 (FIG. 6C) in the lower flange 45.

Figure 8:
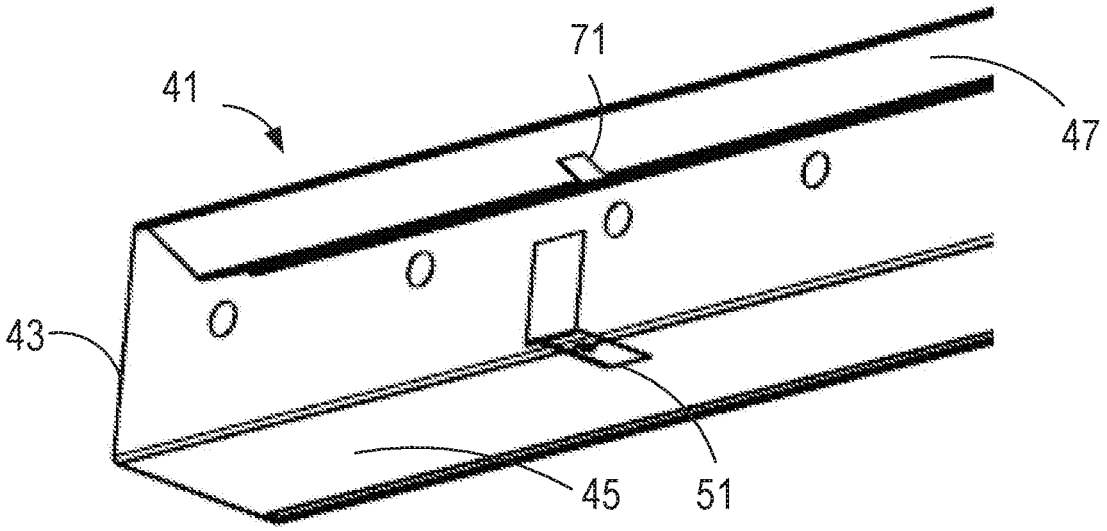
FIG. 8 is a top, front isometric view of an embodiment of a wall bracket.

FIG. 8 is a top, front isometric view of another embodiment of a wall bracket 41. The wall bracket 41 may include a vertical back 43, a lower flange 45 at a lower end of the vertical back 43, and an upper flange 47 at an upper end of the vertical back 43. The upper flange 47 may be V-shaped. In an example, the vertical back 43 and the lower flange 45 can be substantially perpendicular to each other. In a further example, the bracket 41 may be provided with only one hole 71 in the upper flange 47 for each grid member 60.

In some embodiments, the bracket 41 may include only one tab 51 for each grid member 60. The tab 51 may be formed using a section of the vertical back 43. In such embodiments, the tab 51 may be partially cut from the vertical back 43, such as by leaving uncut a section nearest the lower flange 45. In further embodiments, the tab 51 may be folded down toward the lower flange 45. This allows the tab to be located just above the lower flange 45 for connecting a grid member 60 similar to the manner depicted in FIGS. 6A, 6B, and 6C, while avoiding cutting of the lower flange 45 so that the lower flange 45 may hide the grid member 60 from view.

Still other versions may include one or more of the following embodiments:

Embodiment 1. A wall support for a ceiling support grid having grid members, each grid member having a top with a bulb, a web extending downward from the bulb, and a bottom with a flange extending from the web opposite the bulb, the wall support comprising: a bracket comprising a channel that, when viewed longitudinally, is generally C-shaped, the bracket having a vertical back, a lower flange at a lower end of the vertical back, and an upper flange at an upper end of the vertical back; and only one tab in the lower flange for each grid member, wherein the only one tab is configured to engage and retain the flange of a respective grid member, such that the respective grid member rests on the lower flange, and the lower flange has no other features for positive engagement with and retention of the flange of the respective grid member.

Embodiment 2. The wall support of any of these embodiments, wherein the only one tab comprises a locking feature for engaging and retaining the flange of the respective grid member in the only one tab.

Embodiment 3. The wall support of any of these embodiments, wherein the locking feature is a finger that depends downward from and extends in a substantially opposite direction as the only one tab.

Embodiment 4. The wall support of any of these embodiments, wherein the only one tab is inclined downward toward the lower flange, such that the only one tab is not parallel to the lower flange.

Embodiment 5. The wall support of any of these embodiments, wherein the only one tab is substantially parallel to the lower flange.

Embodiment 6. The wall support of any of these embodiments, wherein the only one tab comprises diagonally-oriented end portions.

Embodiment 7. The wall support of any of these embodiments, wherein the only one tab comprises at least one reinforcement rib for stiffness.

Embodiment 8. The wall support of any of these embodiments, wherein the at least one reinforcement rib has a rib height that is greater than a height of the only one tab.

Embodiment 9. The wall support of any of these embodiments, wherein the at least one reinforcement rib comprises a pair of parallel, substantially cylindrical reinforcement ribs that extend from the only one tab, in an opposite direction of the only one tab, to the lower flange.

Embodiment 10. The wall support of any of these embodiments, wherein the vertical back and the lower flange are substantially perpendicular to each other.

Embodiment 11. The wall support of any of these embodiments, wherein the lower flange comprises a pilot hole adjacent the only one tab, and the pilot hole is configured to receive a fastener to engage and secure the flange of the grid member.

Embodiment 12. A wall support for a ceiling support grid having grid members, each grid member having a top with a bulb, a web extending downward from the bulb, and a bottom with a flange extending from the web opposite the bulb, the wall support comprising: a bracket comprising a channel that, when viewed longitudinally, is generally C-shaped, the bracket having a vertical back, a lower flange at a lower end of the vertical back, and an upper flange at an upper end of the vertical back; and the upper flange is generally V-shaped when viewed longitudinally.

Embodiment 13. The wall support of any of these embodiments, wherein a height of a lower apex of the upper flange above the lower flange is less than a height of the grid members.

Embodiment 14. The wall support of any of these embodiments, wherein a height of the vertical back is greater than a height of the grid members.

Embodiment 15. The wall support of any of these embodiments, wherein the V-shaped upper flange comprises an apex that is radiused or at least partially flat.

Embodiment 16. A wall support for a ceiling support grid having grid members, each grid member having a top with a bulb, a web extending downward from the bulb, and a bottom with a flange extending from the web opposite the bulb, the wall support comprising: a bracket comprising a channel that, when viewed longitudinally, is generally C-shaped, the bracket having a vertical back, a lower flange at a lower end of the vertical back, and an upper flange at an upper end of the vertical back; and only one hole is formed in the upper flange for each grid member, such that the bulb of each grid member is configured to be located adjacent a respective only one hole in the upper flange.

Embodiment 17. The wall support of any of these embodiments, wherein the only one hole has a longitudinal length that is greater than that of the bulb.

Embodiment 18. The wall support of any of these embodiments, wherein the only one hole is not flat.

Embodiment 19. The wall support of any of these embodiments, wherein the only one hole is V-shaped.

Embodiment 20. The wall support of any of these embodiments, wherein the only one hole is configured to engage and prevent rotation and torsion of a respective one of the grid members.

Embodiment 21. The wall support of any of these embodiments, wherein the only one hole has a minimum height above the lower flange, and a maximum height above the lower flange, and both the minimum and maximum heights are less than a height of the grid members.

Embodiment 22. A wall support for a ceiling support grid having grid members, each grid member having a top with a bulb, a web extending downward from the bulb, and a bottom with a flange extending from the web opposite the bulb, the wall support comprising: a bracket comprising a channel that, when viewed longitudinally, is generally C-shaped, the bracket having a vertical back, a lower flange at a lower end of the vertical back, and an upper flange at an upper end of the vertical back; and the bulbs of the grid members are configured to seat and be retained in respective holes in the upper flange.

Embodiment 23. A ceiling suspension system, comprising: a plurality of grid members configured to form a grid for the ceiling suspension system, each grid member comprising a bulb, a web and a flange; and a plurality of wall support brackets configured to mount the grid to walls in a structure, each wall support bracket comprises a vertical back, a lower flange at a lower end of the vertical back, and an upper flange at an upper end of the vertical back; and each wall support bracket comprises at least one of the following: (A) only one tab in the lower flange for each grid member, wherein the only one tab is configured to engage and retain the flange of a respective grid member, such that the respective grid member rests on the lower flange, and the lower flange has no other features for positive engagement with and retention of the flange of the respective grid member; (B) the upper flange is generally V-shaped when viewed longitudinally; (C) only one hole formed in the upper flange for each grid member, such that the bulb of each grid member is configured to be located adjacent a respective only one hole in the upper flange; and (D) the bulbs of the grid members are configured to seat in holes in the upper flange.

Embodiment 24. A method of installing a ceiling suspension system, the method comprising: (a) providing a C-channel having an upper flange and a lower flange, and a grid member having a bulb, a web and a flange; (b) inserting the grid member into the C-channel between the upper and lower flanges; (c) rotating the grid member until the bulb of the grid member engages a hole in the upper flange; (d) further rotating the grid member until the flange of the grid member is captured by a tab in the lower flange.

Embodiment 25. The method of any of these embodiments, wherein (b) further comprises initially orienting the grid member at an angle relative to the C-channel, such that the grid member is not vertically upright.

Embodiment 26. A wall support for a ceiling support grid having grid members, each grid member having a top with a bulb, a web extending downward from the bulb, and a bottom with a flange extending from the web opposite the bulb, the wall support comprising: a bracket comprising a channel, the bracket having a vertical back, a lower flange at a lower end of the vertical back, and an upper flange at an upper end of the vertical back; and tabs in the vertical back for each grid member, wherein each tab is configured to engage and retain the flange of a respective grid member, such that the respective grid member rests on the lower flange, and wherein each tab is oriented in the same direction.

Embodiment 27. The wall support of embodiment 26, wherein the tab is partially cut from the vertical back.

Embodiment 28. The wall support of embodiment 27, wherein the tab is folded down toward the lower flange.

Embodiment 29. The wall support of embodiment 28, wherein the grid member may be connected to the bracket without cutting the lower flange.

Embodiment 30. The wall support of embodiment 29, wherein the lower flange hides the grid member from view.

Embodiment 31. A wall support for a ceiling support grid having grid members, each grid member having a top with a bulb, a web extending downward from the bulb, and a bottom with a flange extending from the web opposite the bulb, the wall support comprising: a bracket comprising a channel, the bracket having a vertical back, a lower flange at a lower end of the vertical back, and an upper flange at an upper end of the vertical back; holes formed in the upper flange such that the bulb of each grid member is configured to be located adjacent a respective hole in the upper flange; and tabs for each grid member, wherein each tab is configured to engage and retain the flange of a respective grid member, such that the respective grid member rests on the lower flange, wherein each tab is oriented in the same direction.

Embodiment 32. A wall support for a ceiling support grid, the wall support comprising a bracket and grid members, wherein each grid member comprises a top with a bulb, a web extending downward from the bulb, and a bottom with a flange extending from the web opposite the bulb, wherein the bracket comprises a vertical back, a lower flange at a lower end of the vertical back, and an upper flange at an upper end of the vertical back; wherein the upper flange comprises holes, wherein the lower flange comprises tabs, wherein each tab is configured to engage and retain the flange of a respective grid member, such that the respective grid member rests on the lower flange, wherein each hole is configured to engage and retain the bulb of a respective grid member, and wherein each tab is oriented in the same direction.

Embodiment 33. The wall support of embodiment 32, wherein each tab comprises a locking feature for engaging and retaining the flange of the respective grid member in the tab.

Embodiment 34. The wall support of embodiment 33, wherein the locking feature is a finger that depends downward from and extends in a substantially opposite direction as the tab.

Embodiment 35. The wall support of embodiment 32, wherein each tab comprises a reinforcement rib for stiffness.

Embodiment 36. The wall support of embodiment 35, wherein the reinforcement rib has a rib height that is greater than a height of the only one tab.

Embodiment 37. The wall support of embodiment 32, wherein each tab comprises a pair of parallel, substantially cylindrical reinforcement ribs that extend from the only one tab, in an opposite direction of the only one tab, to the lower flange.

Embodiment 38. The wall support of embodiment 32, wherein the vertical back and the lower flange are substantially perpendicular to each other.

Embodiment 39. The wall support of embodiment 32, wherein the upper flange is generally V-shaped when viewed longitudinally and wherein only one hole is formed in the upper flange for each grid member.

Embodiment 40. The wall support of embodiment 39, wherein a height of a lower apex of the upper flange above the lower flange is less than a height of the grid members.

Embodiment 41. The wall support of embodiment 39, wherein a height of the vertical back is greater than a height of the grid members.

Embodiment 42. The wall support of embodiment 39, wherein the V-shaped upper flange comprises an apex that is radiused or at least partially flat.

Embodiment 43. The wall support of embodiment 39, wherein the only one hole has a longitudinal length that is greater than that of the bulb.

Embodiment 44. The wall support of embodiment 39, wherein the only one hole is V-shaped.

Embodiment 45. The wall support of embodiment 39, wherein the only one hole is configured to engage and prevent rotation and torsion of a respective one of the grid members.

Embodiment 46. The wall support of embodiment 39, wherein the only one hole has a minimum height above the lower flange, and a maximum height above the lower flange, and both the minimum and maximum heights are less than a height of the grid members.

Embodiment 47. A method of installing a ceiling suspension system, the method comprising: (a) providing a C-channel having an upper flange and a lower flange, and a grid member having a bulb, a web and a flange; (b) inserting the grid member into the C-channel between the upper and lower flanges; (c) rotating the grid member until the bulb of the grid member engages a hole in the upper flange; (d) further rotating the grid member until the flange of the grid member is captured by a tab in the lower flange.

Embodiment 48. The method of embodiment 47, wherein (b) further comprises initially orienting the grid member at an angle relative to the C-channel, such that the grid member is not vertically upright.

Embodiment 49. A wall support for a ceiling support grid having grid members, each grid member having a top with a bulb, a web extending downward from the bulb, and a bottom with a flange extending from the web opposite the bulb, the wall support comprising: a bracket comprising a channel, the bracket having a vertical back, a lower flange at a lower end of the vertical back, and an upper flange at an upper end of the vertical back; and tabs in the vertical back for each grid member, wherein each tab is configured to engage and retain the flange of a respective grid member, such that the respective grid member rests on the lower flange, and wherein each tab is oriented in the same direction.

Embodiment 50. The wall support of embodiment 49, wherein the lower flange hides the grid member from view.

Embodiment 51. A wall support for a ceiling support grid having grid members, each grid member having a top with a bulb, a web extending downward from the bulb, and a bottom with a flange extending from the web opposite the bulb, the wall support comprising: a bracket comprising a channel, the bracket having a vertical back, a lower flange at a lower end of the vertical back, and an upper flange at an upper end of the vertical back; holes formed in the upper flange such that the bulb of each grid member is configured to be located adjacent a respective hole in the upper flange; and tabs for each grid member, wherein each tab is configured to engage and retain the flange of a respective grid member, such that the respective grid member rests on the lower flange, wherein each tab is oriented in the same direction.

This written description uses examples to disclose the embodiments, including the best mode, and also to enable those of ordinary skill in the art to make and use the invention. The patentable scope is defined by the embodiments, and may include other examples that occur to those skilled in the art. Such other examples are intended to be within the scope of the embodiments if they have structural elements that do not differ from the literal language of the embodiments, or if they include equivalent structural elements with insubstantial differences from the literal languages of the embodiments.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A ceiling suspension system, comprising:

a plurality of grid members, each grid member comprising a bulb, a web, and a flange; and a plurality of wall support brackets, each wall support bracket comprising an upper flange having at least one hole configured to seat the bulb of each grid member, a vertical back, and a lower flange having at least one tab configured to contact, engage and retain the flange of each grid member, wherein the at least one tab is inclined downward toward the lower flange.

2. The ceiling suspension system of claim 1, wherein the vertical back and the lower flange of each of the plurality of wall support brackets are substantially perpendicular.

3. The ceiling suspension system of claim 1, wherein the at least one hole is configured to retain the bulb of each grid member.

4. The ceiling suspension system of claim 1, wherein the at least one hole prevents lateral movement of the grid members.

5. The ceiling suspension system of claim 1, wherein the at least one hole prevents rotation of the grid members.

6. The ceiling suspension system of claim 1, wherein a portion of the upper flange of each wall support bracket extends downwardly.

7. The ceiling suspension system of claim 6, wherein a height between the portion of the upper flange of each wall support bracket that extends downwardly and the lower flange is less than a height of the grid members.

8. The ceiling suspension system of claim 1, wherein the grid members rest on the lower flange of the plurality of wall support brackets.

9. The ceiling suspension system of claim 8, wherein the grid members are retained between the upper flange and the lower flange of the wall support brackets.

10. The ceiling suspension system of claim 1, wherein the at least one tab is formed using cut portions of the plurality of wall support brackets.

* * * * *